US005477582A

United States Patent [19]

Yamashita

[11] Patent Number: 5,477,582

[45] Date of Patent: Dec. 26, 1995

[54] MOP SHEET HOLDER, AND MOP SHEET THEREFOR

[75] Inventor: Shusuke Yamashita, Hamamatsu, Japan

[73] Assignee: Azuma Industrial Co., Ltd., Hamamatsu, Japan

[21] Appl. No.: 391,223

[22] Filed: Feb. 21, 1995

[30] Foreign Application Priority Data

May 10, 1994 [JP] Japan ..... 6-120669

[51] Int. Cl.[6] ..... A47L 13/20

[52] U.S. Cl. ..... 15/231; 15/228

[58] Field of Search ..... 15/231, 233, 228

[56] References Cited

U.S. PATENT DOCUMENTS

| | | | |
|---|---|---|---|
| 1,487,167 | 3/1924 | Kumagawa | 15/228 |
| 2,301,505 | 11/1942 | Bates | 15/231 |
| 3,012,264 | 12/1961 | Nash | 15/231 |
| 3,015,834 | 1/1962 | Marrinson et al. | 15/228 |

FOREIGN PATENT DOCUMENTS

| | | |
|---|---|---|
| 6-10939 | 3/1994 | Japan . |
| 6-10942 | 3/1994 | Japan . |
| 846413 | 8/1960 | United Kingdom . |
| 2209663 | 5/1989 | United Kingdom . |

*Primary Examiner*—Edward L. Roberts, Jr.

*Attorney, Agent, or Firm*—Oblon, Spivak, McClelland, Maier, & Neustadt

[57] ABSTRACT

A mop having a mop sheet holder member 2 of a short cylindrical shape and of a resiliently flexible material attached to the fore end of a handle stick 1. An axially extending sheet anchoring groove 12 is formed on the top side of the sheet holder member 2 to anchor therein opposite end portions of a mop sheet securely in cooperation with a sheet retainer arm pivotally movable into engagement with the sheet anchoring groove 12 from above.

5 Claims, 7 Drawing Sheets

MOP SHEET HOLDER, AND MOP SHEET THEREFOR

BACKGROUND OF THE INVENTION

1. Field of the Art

This invention relates generally to handled mops to be used for cleaning surfaces of floors, walls, furniture etc. and more particularly to improvements in a mop sheet holder for holding a mop sheet at the fore end of a handle stick.

2. Prior Art

With regard the to mops of the sort mentioned above, it has been known in the art to attach a disposable type cleaning duster sheet of paper or cloth (hereinafter referred to simply as "mop sheet" for brevity) to a sheet holder plate or the like in such a way that, upon application of a strong force, the mop sheet can be pressed against a floor surface or a furniture surface for cleaning purposes. A spent mop sheet on the sheet holder, which has been deposited with a large amount of dust as a result of repeated cleaning operations, is discarded and replaced by a fresh mop sheet.

Regarding the mop sheet holder, it has been the usual practice for the conventional mops of this sort to employ a hard rigid plate of synthetic resin material which lacks flexibility. However, such a mop sheet holder in the form of a hard and rigid plate tends to give unpleasant feelings to the user due to its unyielding or resistive stiffness which is directly felt by the hand of the user in use, particularly when it is pushed down to press the duster sheet against a cleaning surface, resulting in mopping actions of inferior performance quality which requires great efforts on the part of the user, in addition to the possibilities of causing damages to surfaces of walls and furniture on collisional contact thereagainst.

Besides, in most cases, the job of fitting a duster sheet on a hard sheet holder plate as well as the job of removing same from the holder plate is found relatively difficult, and the holder plate lacks considerations for effective use of the duster sheet under various circumstances, suffering from inefficient use of the duster sheet due to inferior mopping actions and inconvenience in handling.

SUMMARY OF THE INVENTION

It is an object of the present invention to provide a mop having a mop sheet replaceably fitted on a sheet holder member with a certain degree of flexibility suitable for improving the mopping actions in cleaning operations and at the same time for facilitating the jobs of putting a mop sheet on and off the holder member, thereby ensuring efficient use of the duster sheet over a broadened surfaces areas thereof.

It is another object of the present invention to provide a mop employing, on the sheet holder member, a mop sheet which is increased in apparent thickness to improve the feeling of the mopping action in cleaning operations.

In accordance with the present invention, for the purpose of solving the above-discussed problems, there is provided a mop of the type including a handle stick, a sheet holder member attached to the fore end of the handle stick, a mop sheet replaceably fitted around the sheet holder member, and a sheet retainer member adapted to anchor the opposite end portions of the mop sheet on the sheet holder member, characterized in that the sheet holder member has a body generally formed into a short cylindrical shape by the use of a flexible material and provided with an axially extending sheet anchoring groove on the upper side thereof, and the sheet retainer member is constituted by a retainer arm pivotally movable between an operative position where the retainer arm is engaged with the axial sheet anchoring groove on the sheet holder member for fixedly anchoring opposite end portions of the mop sheet therein and a free position where the retainer arm is disengaged from the sheet anchoring groove on the sheet holder member for releasing the mop sheet.

In a preferred form of the invention, the above-mentioned handle stick is substantially constituted by a single rod-like member and pivotally connected at its fore end substantially to a center portion of the sheet holder member on the upper side thereof, and a couple of retainer arms are pivotally supported at the respective base ends at the opposite lateral sides of the handle stick.

In another preferred form of the invention, the handle stick is constituted by a couple of stick members, i.e., first and second stick members connected with each other in such a way as to be openably foldable one on the other, the first stick member being attached to the sheet holder member with the respective axes substantially in,parallel relation with each other, and the second stick member being arranged to serve as a retainer arm to be engaged with the sheet anchoring groove on the sheet holder member when folded on the first stick member.

According to the invention, preferably the sheet holder member has a body which is formed in a hollow cylindrical shape.

Further, the mop sheet to be fitted on the sheet holder member is preferably pleated except its opposite end portions for the purpose of increasing its substantial thickness in mopping actions.

In a cleaning operation with the mop of the above-described arrangements, the mop sheet on the sheet holder member is lightly pushed against a cleaning surface while moving the mop to the left and right in the fashion of a broom to wipe off dust. In doing so, the sheet holder member undergoes flexures by resilient deformations in response to the rightward and leftward mopping actions, giving a friendly feeling to the hand of the operator.

The flexibility of the mop sheet holder gives an agreeable feeling to the user in each mopping action since the mop sheet can be pressed against a cleaning surface with a moderate force, free of any resistive stiffness which would be reflected by a great burden on the hand. Besides, there is almost no possibility of the flexible sheet holder member causing damages to wall surfaces, furniture or other surfaces which might come into contact with the holder member, ensuring care-free efficient cleaning work with the mop.

Further, according to the invention, the opposite end portions of the mop sheet, which is wrapped around the sheet holder member, are securely and replaceably anchored in the sheet anchoring groove on the upper side of the sheet holder member by means of the retainer arm which is pivotally movable between an operative position and a free position. Therefore, it becomes possible to put a mop sheet unit on the sheet holder member in an extremely facilitated manner or to remove a spent mop sheet therefrom very easily at the time of mop sheet replacement. In addition, except limited areas in the end portions which are anchored in the groove on the sheet holder member, almost entire areas of the mop sheet are exposed to the outside to serve for cleaning operations effectively with an extremely high efficiency.

DESCRIPTION OF PREFERRED EMBODIMENTS

Figure 1:
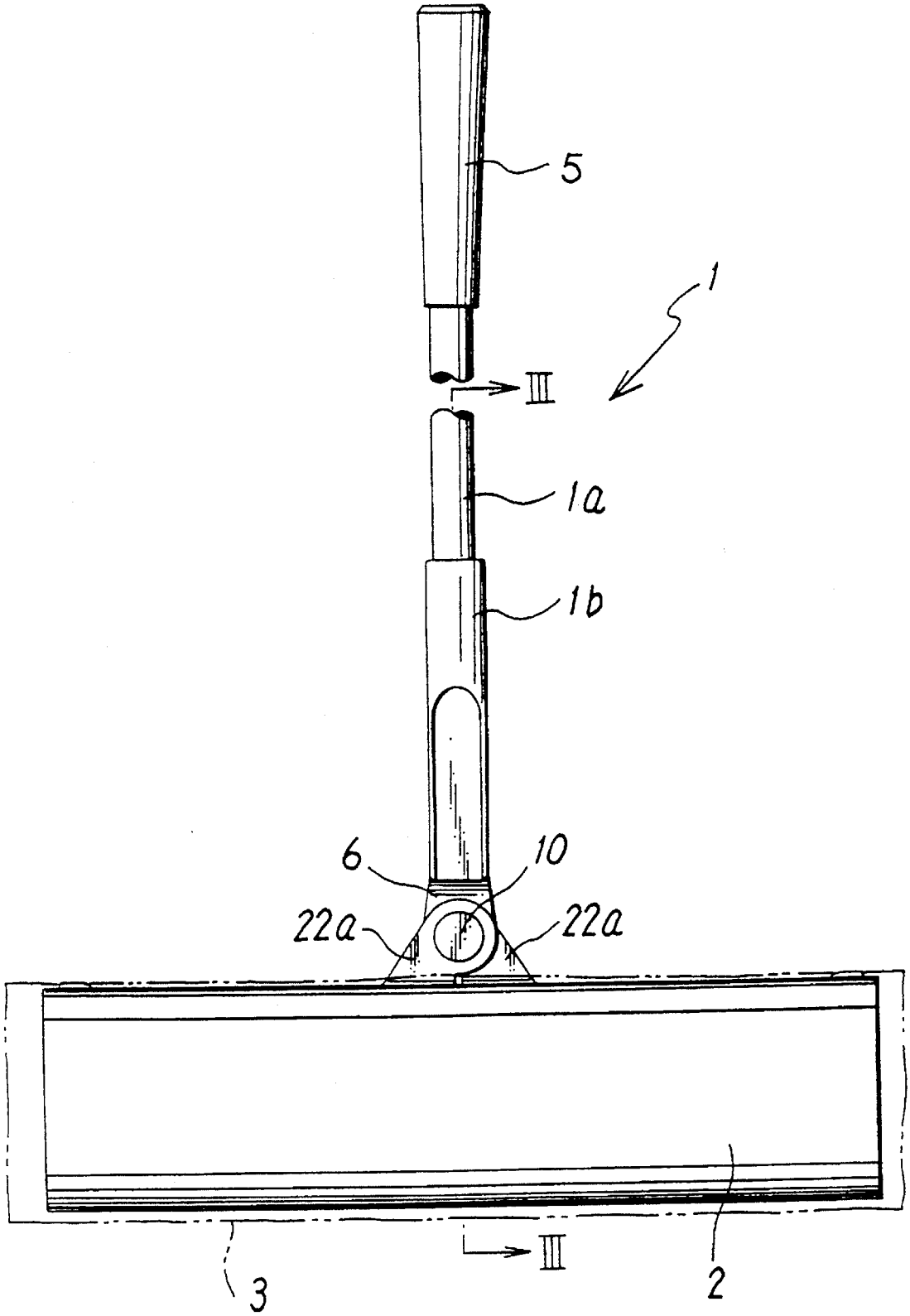
FIG. 1 is a partly cutaway front view of a first embodiment of the mop according to the invention.

Hereafter, the invention is described more particularly by way of its preferred embodiments with reference to the accompanying drawings.

Referring to FIGS. 1 through 6, there is shown a first embodiment of the mop according to the invention, which includes a handle stick. 1, a sheet holder member 2 of a short cylindrical shape transversely attached to the fore end of the handle stick 1, a mop sheet 3 (shown only in FIGS. 1 and 6) replaceably wrapped around the sheet holder member 2, and a sheet retainer means 4 for holding the mop sheet 3 in the wrapped position on the sheet holder member 2.

The above-mentioned handle stick 1 is constituted by a pipe or pipes of metallic or synthetic resin material of substantially a single rod-like shape, including a main stick body 1*a* with a grip 5 at its proximal end and a connecting end section 1*b* attached to the fore end of the main stick body 1*a*. The connecting end section 1*b* is bifurcated at its fore end 6 to which a socketed joint member 8 is pivotally connected by a pin 10. The just mentioned socketed joint member 8 forms part of the connection means which articulately connects the sheet holder member 2 to the fore end 6 of the connecting section 1*b* of the handle stick 1.

As seen in FIGS. 2 through 5, the connection means which connects the sheet holder member 2 to the handle stick 1 is constituted by the afore-mentioned socketed joint member 8 and a clasp member 9.

The socketed joint member 8 is provided with a narrowly extending channel portion 13 of substantially U-shape in section, which is arranged to hold from beneath the walls of a sheet anchoring groove in the form of an indented channel 12 provided on the top side sheet holder member 2, and an articular link member 14 uprising substantially from the center of the channel portion 13. The articular link member 14 is fitted between the bifurcated portions at the fore end 6 of the connecting end section 1*b* of the handle stick 1 and pivotally connected to the latter by means of a pin 10.

Figure 5:
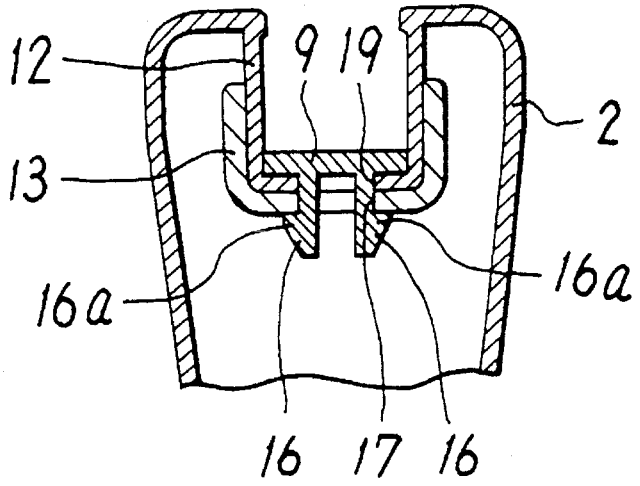
FIG. 5 is an enlarged sectional view of the mop taken on line V—V of FIG. 4.

On the other hand, the clasp member 9 is in the form of an elongated plate with an width which is smaller than the inside width of the channel portion 13 of the socketed joint member 8, and fitted in the indented channel 12 on the sheet holder member 2 to grip the walls of the channel 12 securely in cooperation with the socketed joint member 8. As seen in FIG. 5, the clasp member 9 is provided with a plural number of pairs of resilient stopper projections 16 with outwardly projecting claws 16*a* on its lower side at suitably spaced positions in its longitudinal direction. The stopper projections 16 are resiliently disengageably engaged with edges of perforations in the channel portion 13 to unite the socketed joint member 8 and the clasp member 9 securely with each other.

The clasp member 9 may be constituted by a single elongated plate which is substantially coextensive with the channel portion 13 of the socketed joint member 8, or by a couple of shorter plates which are located on the opposite sides of the uprising link portion 14. In case of a single elongated plate, it is centrally provided with an opening to receive the link portion 14 therein.

The sheet holder member 2 which holds the mop sheet 3 is formed in a hollow tubular shape by the use of a soft and resiliently flexible material such as synthetic resin, rubber or the like, generally presenting a heart-like cross-sectional shape which is somewhat elongated toward a rounded bottom end. On the upper side, the sheet holder member 2 is provided with an axially extending groove or channel 12 of substantially U-shape in section, which groove 12 being provided with an opening 18 in its bottom wall for receiving the articular link portion 14 of the socketed joint member 8, along with perforations 19 for receiving the stopper projections 16 of the clasp member 9.

The sectional shape of the sheet holder member 2 is not restricted to the particular example shown, and may be any other arbitrary shape. Preferably, it should have a shape which is elongated in the vertical direction to such a degree as will cause flexing movements of the sheet holder member 2 for the friendly mopping action. Examples of suitable shapes include vertically elongated elliptic shapes or vertically elongated rectangular, trapezoidal or triangular shapes with rounded corners. Further, the sheet holder member 2 can be obtained simply by cutting an extrudate of a predetermined sectional shape into a desired unit length.

Figure 6:
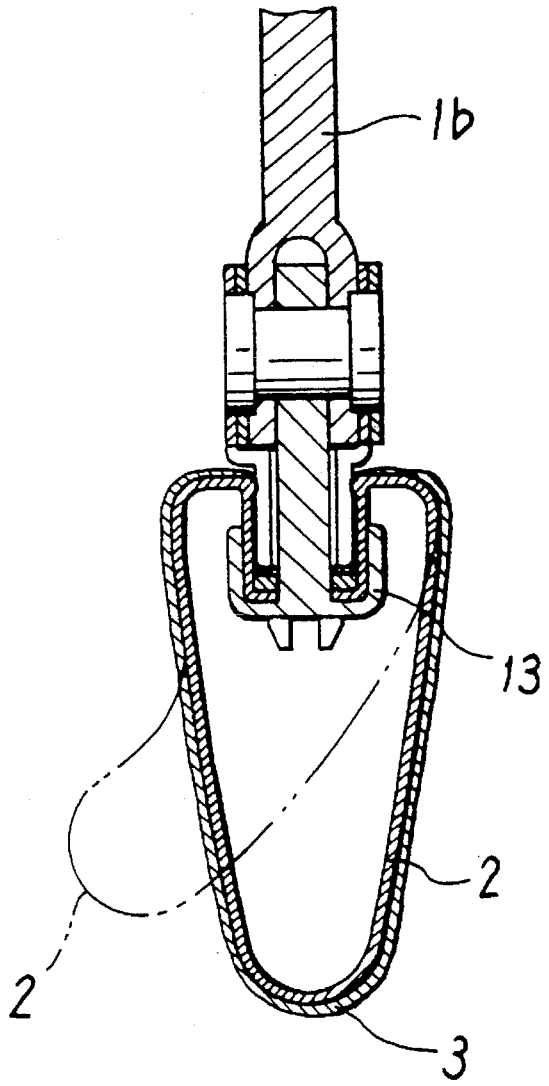
FIG. 6 is a sectional view taken in the same position as in FIG. 3, showing a mop sheet fitted on the sheet holder member of the mop of FIG. 1.
Figure 7:
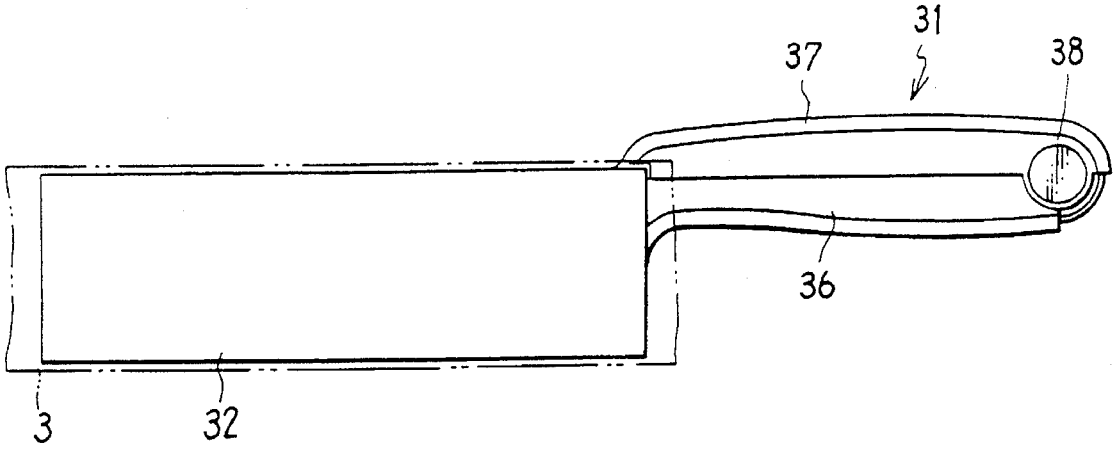
FIG. 7 is a side view of a second embodiment of the mop according to the present invention.

The mop or mop sheet 3 which is fitted on the sheet holder member 2 is formed of an arbitrary sheet-like material such as a sheet of paper including tissue paper or a sheet of woven or non-woven cloth, which is cut into a predetermined size, and, as shown in FIGS. 1 and 6, wrapped around the sheet holder member 2 from beneath and set in position on the sheet holder member 2 with its opposite end portions pushed and securely anchored in the groove 12 on the sheet holder member 2 by the sheet retainer means 4.

By fitting the mop sheet 3 on the sheet holder member 2 in this manner, almost entire areas of the mop sheet 3 are exposed except very limited areas of the opposite end portions which are anchored in the groove 12, thus letting the mop sheet contribute to cleaning operations effectively over broadened areas to make the maximum use of the mop sheet in an efficient manner. The efficiency in use can be improved all the more by the use of a mop sheet of a reversible type which can be reversed inside out when the cleaning capacity of its exposed outer surface has been deteriorated markedly due to deposition of a large quantity of dust.

The mop sheet 3 may be impregnated with a dust adsorptive agent although it is not essential.

Figure 2:
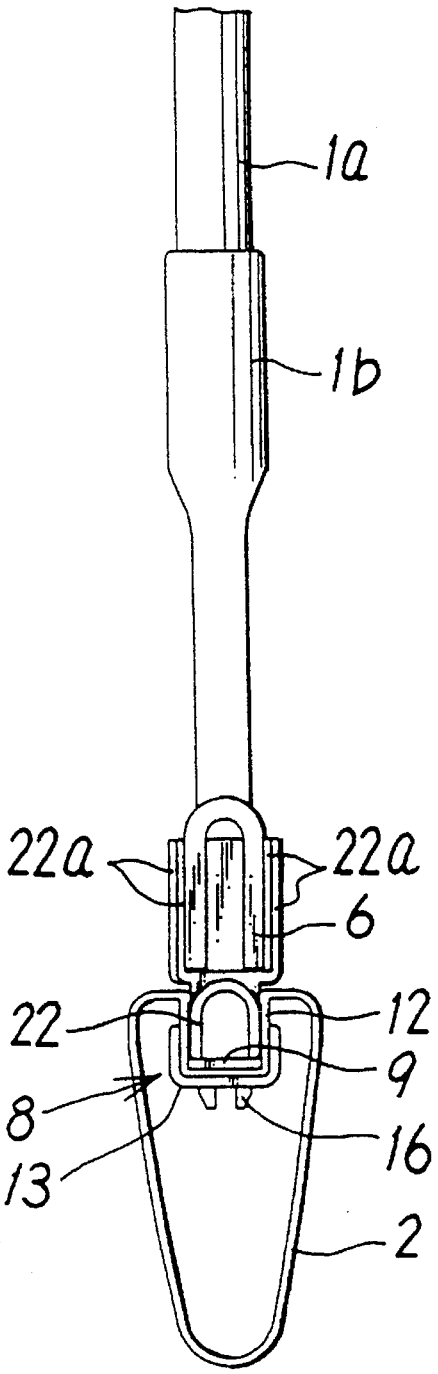
FIG. 2 is a side view of the mop of FIG. 1, with its mop sheet omitted for the sake of simplicity of illustration.
Figure 3:
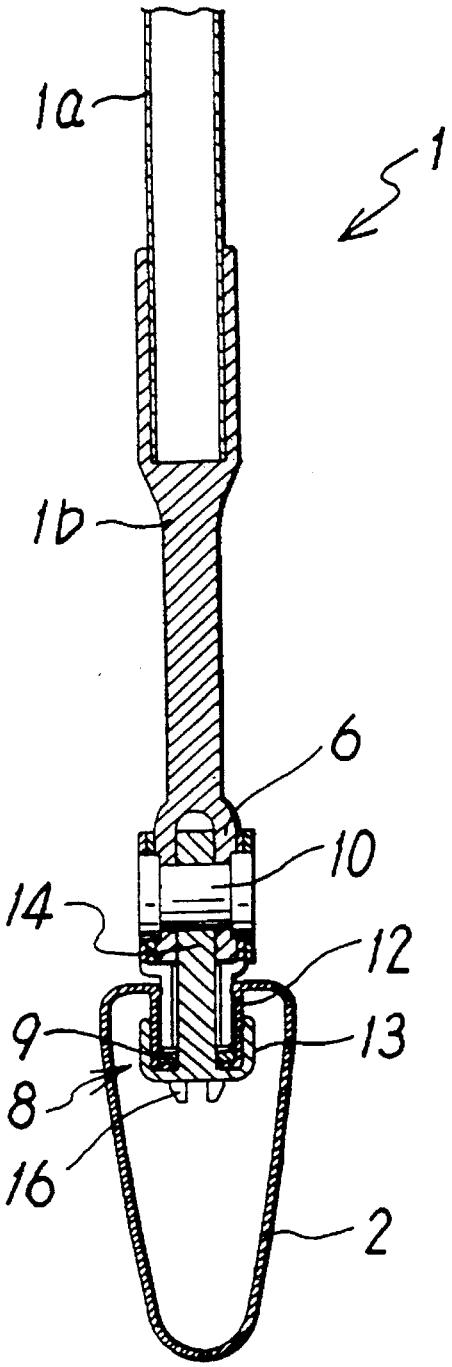
FIG. 3 is a sectional view taken on line III—III of FIG. 1, likewise with the mop sheet omitted for the sake of simplicity of illustration.
Figure 4:
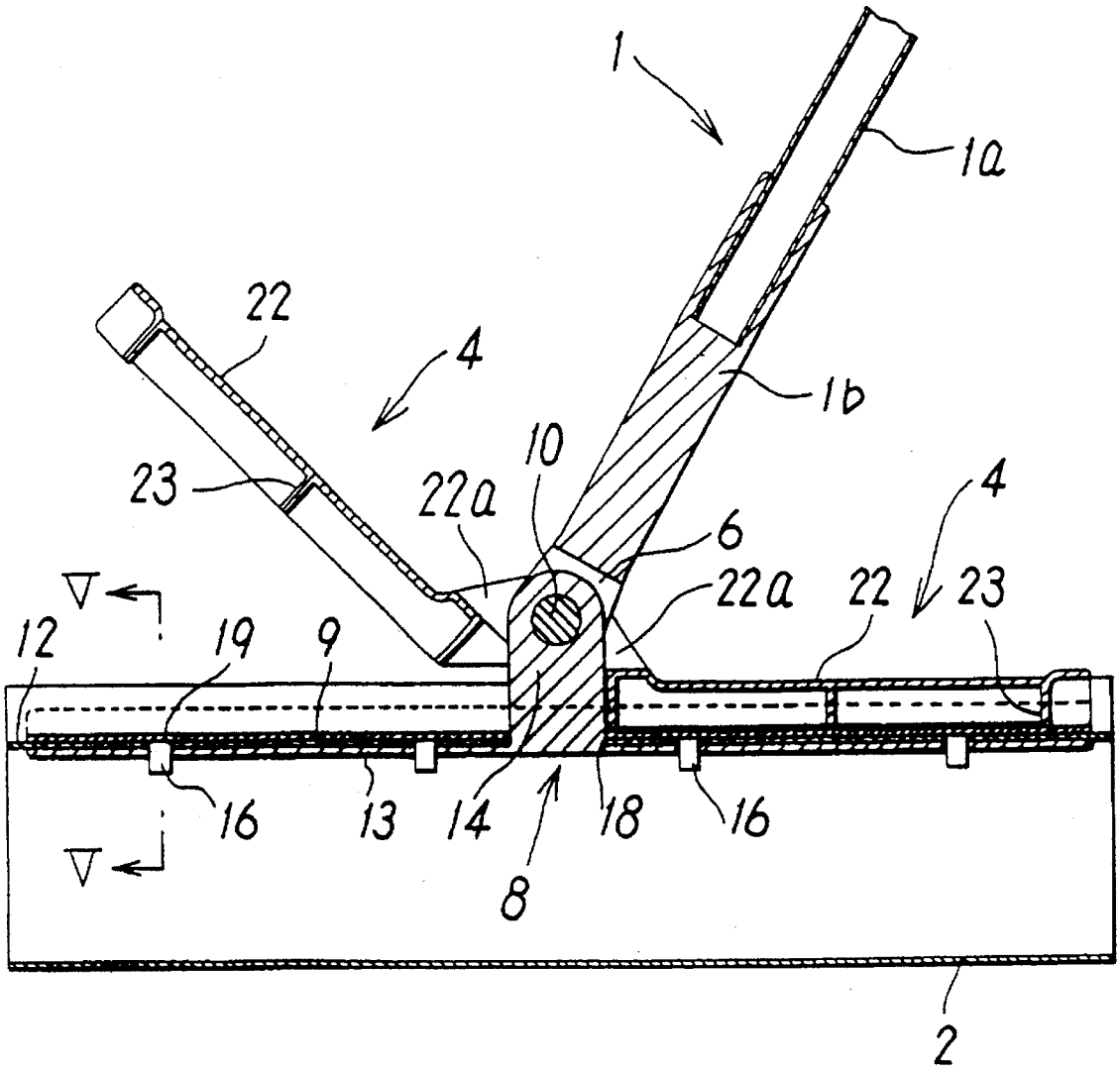
FIG. 4 is a sectional view of the mop taken on line IV—IV of FIG. 2, having one of sheet retainer arms shifted to a free position.

The sheet retainer means 4 which retains the mop sheet in the wrapped position on the sheet holder member 2 is constituted by a couple of retainer arms 22 which are pivotally supported at the opposite sides of a fore end portion of the handle stick 1. As seen in FIGS. 2 and 4, these retainer arms 22 are each in the form of an elongated rod which is formed in an inverted U-shape in section and provided with reinforcing ribs 23. The base end of each retainer arm 22 is formed into bifurcated support portions 22*a* which are fitted in such a way as to sandwich therebetween the bifurcated fore end portion 6 of the coupler section 1*b* of the handle stick and pivotally connected to the latter by means of a pin 10. Therefore, the retainer arms 22 are pivotally movable between an operative or anchoring position (as shown in the right half of FIG. 4), where they are in engagement with the groove 12 on the sheet holder member 2 to anchor opposite end portions of the mop sheet 3 in the groove 12, and a free position (as shown in the left half of FIG. 4), where they are disengaged from the groove 12 to release the mop sheet 3.

The retainer arms 22 can be stopped in the operative position by the frictional force against the mop sheet 3 or by the resilient force of the sheet holder member 2. If desired, arrangements may be made such that rotational movements of the retainer arms 22 are met by a suitable frictional force which is strong enough to stop the retainer arms 22 at an arbitrary position along the loci of their rotational movements. In this regard, although the two retainer arms 22 are arranged to be rotatable separately or independently of each other in the particular embodiment shown, they may be intermeshed through gears or other coupling means to rotate them in an interlinked fashion.

As described hereinbefore, the mop sheet 3 are securely anchored in the groove 12 on the sheet holder member 2 in its opposite end portions by the action of the retainer arms 22 which are pivotally movable between the anchoring position and the free position as described above, so that the mop sheet 3 can be mounted securely in position in an extremely facilitated manner and it can be removed therefrom easily at the time of replacement.

The mop of the above-described arrangements according to the invention is used as illustrated in FIG. 6, lightly pressing the mop sheet 3 on the sheet holder member 2 against a cleaning surface and moving same to the right and left in that figure in the fashion of a broom to wipe off dust therefrom. At this time, the sheet holder member 2 is flexed to the left and right as indicated by a chain line in FIG. 6 to provide flexible sweeping actions like a broom.

It follows that the mopping actions in cleaning operations with the above-described mop give an extremely good feeling to the user, without necessitating to apply large forces or without reacting by resistive stiffness which would impose great burdens on the hand of the operator. Besides, the sheet holder member 2 has less possibilities of causing damages to surfaces of walls and furniture which may come into collisional contact with the mop, making the handling of the mop easier to a considerable degree. Thus, as compared with the conventional mops which require a strong force for the mopping action, the mop of the invention is conspicuously improved in friendly touch in use and easiness of handling, making it possible to obtain effects which cannot be expected from the conventional mops.

Further, the sheet holder member 2 which is formed in a hollow cylindrical shape can be put in smooth flexural motions when in a mopping action, without causing frictions or positional deviations of the mop sheet 3 to any material degree. Namely, in case the sheet holder member 2 has a non-hollow solid body, one side of the sheet holder member 2 tends to be stretched over the other compressive side when it is flexed in the direction indicated by a chain line in FIG. 6, causing frictions between the sheet holder member 2 and the mop sheet 3 which is not stretchable or contractible. The greater the friction between them, the smaller becomes the degree of flexural movements of the sheet holder member 2 which is pulled back by the non-elastic mop sheet. In this regard, in case of the sheet holder member 2 with a hollow body as in the present invention, on a flexural deformation, the compressive side of the sheet holder member 2 (the left side of the body indicated by a chain line in FIG. 6) buckles down into an inwardly concave form as seen in the same figure to flex itself without entailing elongations or contractions. As a consequence, the sheet holder member 2 can be flexed very smoothly free of frictions against the mop sheet 3.

When it is desired to reverse or replace the mop sheet 3, it can be removed from the sheet holder member 2 by turning the retainer arms 22 away from the sheet anchoring groove 12 and into arbitrary free positions.

Referring now to FIGS. 7 to 11, there is shown a mop in a second embodiment of the invention, including an openably foldable handle struck 31 which also functions as sheet retainer means, a sheet holder member 32 arranged substantially in the same manner as in the foregoing first embodiment and attached to the handle stick 31, and a mop sheet 3 fitted on the sheet holder member 32.

More specifically, the handle stick 31 is composed of a first stick member 36 to be connected, to the sheet holder member 32, and a second stick member 37 which serves as a retainer arm 35 of the above-mentioned sheet retainer means. The second stick member 37 is pivotally connected at its base end to the fore end of the first stick member 36, so that it is openably foldable on the latter. The first stick member 36 is formed with an elongated channel portion 36*a* of U-shape in section along its lower side for embracing from beneath an indented channel or groove 40 which is formed on the top side of the sheet holder member 32. The sheet holder member 32 is supported on the channel portion 36*a* in parallel relation with the axis of the first stick member 36 and fixed in position on the channel portion 36*a* by means of an elongated plate-like clasp member 41 which is press-fitted in the groove 40. In a manner similar to the above-described first embodiment, the clasp member 41 is provided with a plural number of paired resilient stopper projections with outwardly extending claws at suitable spaced positions in the longitudinal direction thereof. These stopper projections are resiliently engageable in interlocking holes which are provided in the channel portion 36*a* of the first stick member 36.

Figure 11:
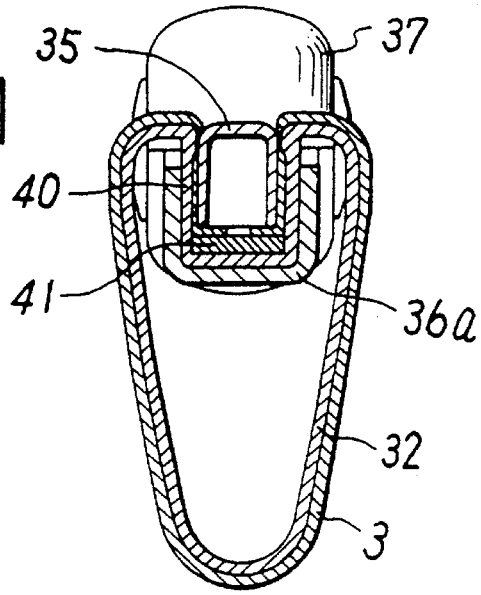
FIG. 11 is an enlarged sectional view of the mop taken in the same position as in FIG. 9, having a mop sheet fitted thereon.

On the other hand, the second stick member 37 is provided with the retainer arm 35 on the side which faces the above-described channel portion 36*a*, for engagement with the groove 40 on the sheet holder member 32. Namely, when the second stick member 37 is folded on the first stick member 36 as illustrated in FIG. 11, the retainer arm 35 is fitted into the groove 40 to anchor opposite end portions of the mop sheet 3 securely within the groove 40.

Figure 8:
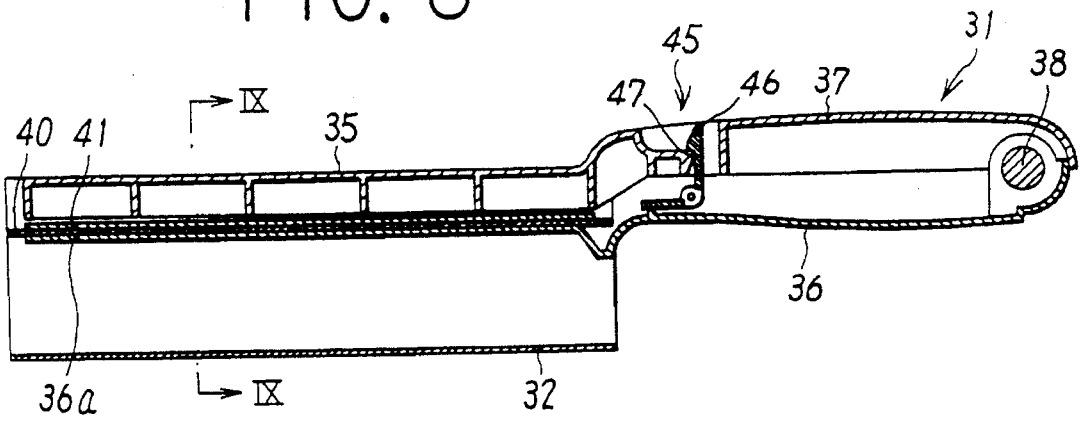
FIG. 8 is a longitudinal sectional view of the mop of FIG. 7, with its mop sheet omitted for the sake of simplicity of illustration.
Figure 9:
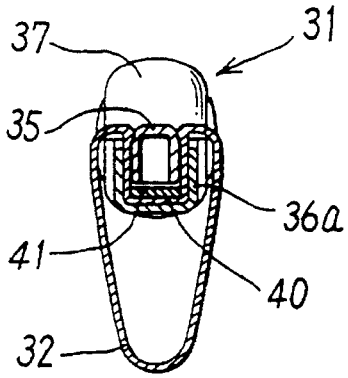
FIG. 9 is a sectional view of the same mop taken on line IX—IX of FIG. 8.
Figure 10:
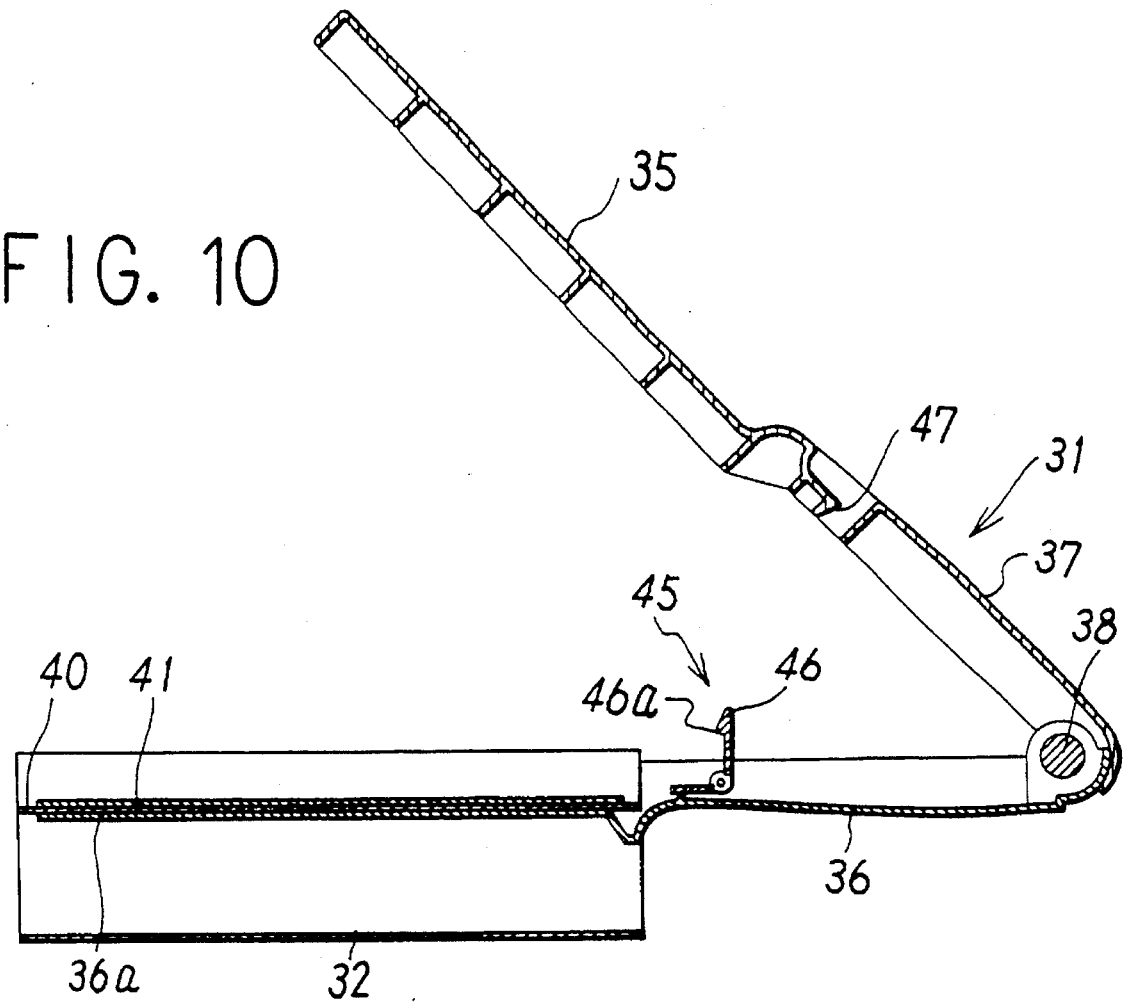
FIG. 10 is a sectional view similar to FIG. 9, showing sheet retainer arm of the mop in a free position.

As shown in FIGS. 8 and 10, the handle stick 31 is provided with a lock means 45 thereby to hold the two stick members 36 and 37 in a closed state. The lock means 45 includes a resilient locking member 46, which is projectingly provided on the part of the first stick member 36, and a locking hole 47 which is provided on the part of the second stick member 37. When the two stick members 36 and 37 are folded into the closed state, a pawl **46*a* of the resilient locking member 46 is resiliently engaged with marginal edges of the locking hole 47. In order to open the two stick members 36 and 37 away from each other, the resilient locking member 46 which is exposed on the upper side of the second stick member 37 is pushed to disengage its pawl 46*a* from the locking hole 47**.

The above-described resilient locking member 46 is arranged to be disengaged from the locking hole 47 through resilient deformation in the particular embodiment shown. Alternatively, there may be employed a locking member which is rockably supported on the first stick member 36 at its base end by means of a pin in such a way that it can be brought into and out of engagement with the locking hole 47 by rocking movements about the pin.

The performance by the mop of the second embodiment is substantially same as that of the first embodiment, so that detailed description in this regard is omitted here to avoid unnecessary repetitions.

Figure 12:
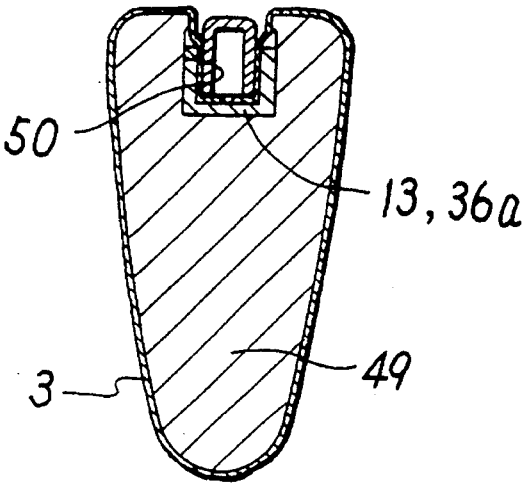
FIG. 12 is a sectional view of a modification of the sheet holder member for the mop of the invention.
Figure 13:
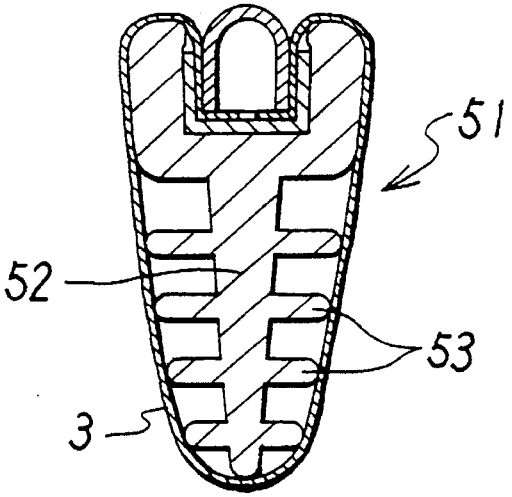
FIG. 13 is a sectional view of another modification of the sheet holder member for the mop of the invention.

Although the sheet holder member 2 or 32 in the foregoing first and second embodiments has a body of a hollow tubular shape, it may have a solid body as exemplified in FIGS. 12 and 13 which show typical examples of solid sheet holder bodies which are imparted with a suitable degree of resiliency and flexibility.

More specifically, FIG. 12 shows a sheet holder member 49 with a solid body which is similar to the sheet holder members in the first and second embodiments in sectional shape and which is formed of a resiliently elastic material such as synthetic resins, rubber or synthetic resin foams. The sheet holder member 49 of this sort is attached to the handle stick 1 or 31 as in the above-described first or second embodiment. In this case, however, the channel portion 13 or **36*a* of the handle stick is fitted in the groove 50 on the top side of the sheet holder member 49, and securely fixed to the latter by the use of an adhesive or by means of suitable fixation means, for example, by means of locking projections which are formed on the channel portion for interlocking engagement with locking holes in the side walls of the groove 50. Therefore, the clasp member 9 or 11** is not required in this case. In other respects, the mop construction is substantially same as in the first and second embodiments, and the description on the common parts is omitted to avoid repetitions.

Referring now to FIG. 13, there is shown a sheet holder member 51 which is provided with a number of longitudinal ribs 53 on the opposite sides of a thin center wall 52 in such a manner as to present substantially the same outer configuration as the sheet holder members 2 and 23 of the first and second embodiment for wrapping therearound the mop sheet 3 of the same size. The sheet holder member 51 of FIG. 13 can also be formed of a synthetic resin material, rubber, foamed synthetic resin material or the like. This sheet holder member is attached to the handle stick substantially in the same manner as the sheet holder member 49 of FIG. 12, so that detailed description in this regard is also omitted here.

Figure 14:
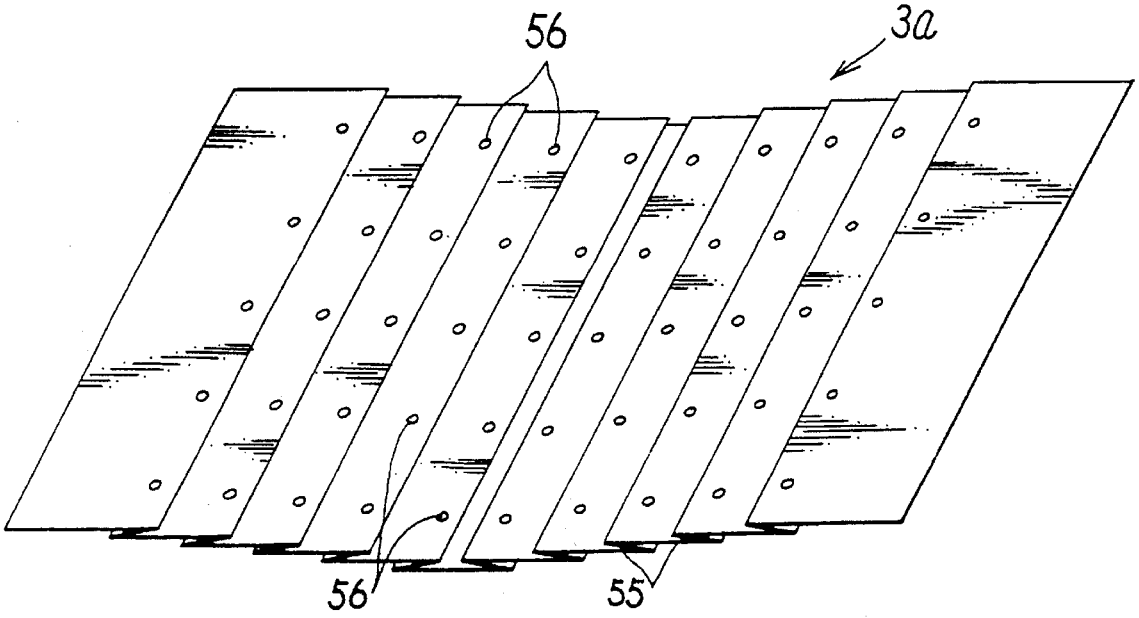
FIG. 14 is a developed view of a modified mop sheet assembly unit useful for the mop of the invention.

Illustrated in FIG. 14 is a modified construction of the mop sheet, more specifically, a mop sheet **3*a* which contains a large number of pleats 55 in contrast to the flat or planar mop sheet 3 which has been shown in connection with the foregoing embodiments. The provision of pleats 55 in the mop sheet 3*a* is effective for markedly improving the feeling of mopping action by increasing the apparent thickness of the mop sheet itself, particularly in case the mop sheet consists of a single relatively thin sheet of paper. In this case, it is desirable to fix the pleats 55 by means of linear or dot-like spot seals at a number of discrete places thereby to keep the respective pleats 55** from spontaneously unfolding into a flat state during use of the mop. The useful spot sealing means include, for example, heat sealing and adhesive sealing.

The mop sheet **3*a* with pleats 55 is wrapped on the sheet holder member in the same manner as the unpleated plain mop sheet 3. In addition to the betterment of the feeling of mopping action, the pleats 55** serves to improve the dust catching capacity of the sheet. The pleated mop sheet can also be reversed to use the rear side of the sheet after using the front side.

As described above, the mop according to the present invention has a mop sheet wrapped around a sheet holder member which is formed of a resilient material to impart thereto a high degree of flexibility, so that dust on a cleaning surface can be wiped off by pushing the mop sheet on the sheet holder lightly against the cleaning surface and lightly swinging the mop to the right and left in the fashion of the sweeping actions of a broom. The flexibility of the sheet holder member gives a better feeling to the hand of the operator, permitting to use the mop effortlessly as its mopping action is not hindered by resistive stiffness of the sheet holder which would impose a great burden on the hand of the operator. Besides, the flexible sheet holder member is less likely to cause damages to the surfaces of walls, furniture or other furnishings, adding to the handiness of the mop to a marked degree.

Further, according to the invention, a mop sheet wrapped on the sheet holder member is fixed in position on the sheet holder member by anchoring opposite end portions of the mop sheet in the groove on the upper side of the sheet holder member by means of the retainer arm which is rotatable into and out of fitting engagement with the groove on the sheet holder member. Therefore, a mop sheet can be securely fitted on the sheet holder member in an extremely facilitated manner, and can be easily removed therefrom at the time of replacement. Besides, except limited end portions which are anchored in the groove of the sheet holder member, almost entire areas of the mop sheet are exposed to the outside to serve for cleaning operations effectively over an extremely widened area, permitting efficient use of the mop sheet.

What is claimed is:

1. A mop of the type having a handle stick, a sheet holder member attached to the fore end of said handle stick, a mop sheet replaceably fitted on said sheet holder member, and a sheet retainer member adapted to anchor the opposite end portions of said mop sheet on said sheet holder member, characterized in that said sheet holder member has a body generally formed in a relatively short cylindrical shape by the use of a flexible material and provided with an axially extending sheet anchoring groove on the upper side thereof, and said sheet retainer member is constituted by at least one retainer arm pivotally movable between an operative position where said retainer arm is engaged with said axial sheet anchoring groove on said sheet holder member for fixedly anchoring opposite end portions of said mop sheet therein and a free position where said retainer arm is disengaged from said sheet anchoring groove on said sheet holder member for releasing said mop sheet.

2. A mop as defined in claim 1, wherein said handle stick is substantially constituted by a single rod-like member and pivotally connected at its fore end substantially to a center portion of said sheet holder member on the upper side thereof, and a couple of retainer arms are pivotally supported at the respective base ends at the opposite lateral sides of said handle stick.

3. A mop as defined in claim 1, wherein said handle stick is constituted by a couple of stick members, a first stick member and a second stick member, connected with each other in such a way as to be openably foldable one on the other, said first stick member being attached to said sheet holder member with the respective axes substantially in parallel relation with each other, and said second stick member being arranged to serve as a retainer arm to be engaged with said sheet anchoring groove on said sheet holder member when folded and closed on said first stick member.

4. A mop as defined in any of claims 1 to 3, wherein said sheet holder member has a body generally of a hollow cylindrical shape.

5. A mop as defined in claim 1, wherein said mop sheet fitted on said sheet holder member is pleated except opposite end portions thereof for the purpose of increasing a substantial sheet thickness in mopping operations.

* * * * *